US010232999B2

(12) United States Patent
Lingamfelter

(10) Patent No.: US 10,232,999 B2
(45) **Date of Patent: *Mar. 19, 2019**

(54) CONTAINER FOR PROVIDING EASY ACCESS TO BEVERAGE CANS

(71) Applicant: C. Brown Lingamfelter, Stuart, FL (US)

(72) Inventor: C. Brown Lingamfelter, Stuart, FL (US)

( * ) Notice: Subject to any disclaimer, the term of this patent is extended or adjusted under 35 U.S.C. 154(b) by 662 days.

This patent is subject to a terminal disclaimer.

(21) Appl. No.: 14/835,107

(22) Filed: Aug. 25, 2015

(65) Prior Publication Data

US 2016/0060011 A1 Mar. 3, 2016

Related U.S. Application Data

(63) Continuation of application No. 10/997,712, filed on Nov. 24, 2004, now Pat. No. 9,926,121, which is a (Continued)

(51) Int. Cl.

| | |
|---|---|
| ***B65D 75/00*** | (2006.01) |
| ***B65D 71/36*** | (2006.01) |
| ***B65D 5/02*** | (2006.01) |
| ***B65D 5/16*** | (2006.01) |
| ***B65D 5/468*** | (2006.01) |

(Continued)

(52) U.S. Cl.

CPC ..... *B65D 71/36* (2013.01); *B65B 11/004* (2013.01); *B65B 61/14* (2013.01); *B65B 61/18* (2013.01);

(Continued)

(58) Field of Classification Search

CPC ..... B65D 71/36; B65D 5/0227; B65D 5/16; B65D 5/4608; B65D 5/542; B65D 2571/00561; B65D 2571/00895; B65D 2571/00901; B65B 61/14; B65B 61/18; B65B 11/004

(Continued)

(56) References Cited

U.S. PATENT DOCUMENTS 2,754,047 A * 7/1956 Schmidt ..... B65D 5/542 206/147

2,842,304 A * 7/1958 Ringler ..... B65D 5/46192 206/428

(Continued)

FOREIGN PATENT DOCUMENTS

JP 11-17-1264 6/1999

OTHER PUBLICATIONS

USPTO, Board of Patent Appeals and Inteferenes, *Meadwestaco Packaging Systems, et. al.* v. *Patent of C. Brown Lingamfelter*, Appeal 2009-002578, ReExamination Control Nos.

(Continued)

*Primary Examiner* — Luan K Bui

(74) *Attorney, Agent, or Firm* — Jackson Walker LLP

(57) ABSTRACT

A container having a multiplicity of cans therein. The container disclosed is modified from a rectangular, closed wall container to a container with part of the walls removed, thereby allowing easy access to the cans of the container. Applicant discloses a unique relationship between the walls of the opened container and the size of the beverage cans. Applicant also discloses a method for constructing a closed container that may be easily modified to remove the cans of the container.

23 Claims, 3 Drawing Sheets

Related U.S. Application Data continuation of application No. 10/935,209, filed on Sep. 7, 2004, now abandoned, which is a continuation of application No. 10/388,951, filed on Mar. 14, 2003, now Pat. No. 6,789,673, which is a continuation of application No. 09/946,004, filed on Sep. 4, 2001, now Pat. No. 6,550,615, and a continuation of application No. 09/542,661, filed on Apr. 4, 2000, now Pat. No. 6,283,293.

(51) Int. Cl.

| | |
|---|---|
| ***B65D 5/54*** | (2006.01) |
| ***B65B 11/00*** | (2006.01) |
| ***B65B 61/14*** | (2006.01) |
| ***B65B 61/18*** | (2006.01) |

(52) U.S. Cl.

CPC ..... *B65D 5/0227* (2013.01); *B65D 5/16* (2013.01); *B65D 5/4608* (2013.01); *B65D 5/542* (2013.01); *B65D 2571/0045* (2013.01); *B65D 2571/0058* (2013.01); *B65D 2571/0066* (2013.01); *B65D 2571/00141* (2013.01); *B65D 2571/00456* (2013.01); *B65D 2571/00561* (2013.01); *B65D 2571/00574* (2013.01); *B65D 2571/00728* (2013.01); *B65D 2571/00895* (2013.01); *B65D 2571/00901* (2013.01)

(58) Field of Classification Search

USPC ..... 206/427; 53/412, 492

See application file for complete search history.

(56) References Cited

U.S. PATENT DOCUMENTS

| | | | | | |
|---|---|---|---|---|---|
| 3,178,242 | A | * | 4/1965 | Ellis | B65D 71/36 206/738 |
| 3,356,279 | A | * | 12/1967 | Root | B65D 71/36 206/427 |
| 3,517,858 | A | * | 6/1970 | Farquhar | B65D 71/36 206/427 |
| 3,712,533 | A | | 1/1973 | Skillen | |
| 4,155,449 | A | | 5/1979 | Bryne | |
| 4,417,661 | A | | 11/1983 | Rocccaforte | |
| 4,498,581 | A | | 2/1985 | Dutcher | |
| 4,785,991 | A | * | 11/1988 | Schuster | B65D 5/4608 206/141 |
| 5,249,681 | A | * | 10/1993 | Miller | B65D 71/36 206/427 |

OTHER PUBLICATIONS

U.S. Appl. Nos. 95/000,066 and 95/000,069, Decided: Jan. 12, 2010.

U.S. Appl. Nos. 95/000,066 and 95/000,069, Decided: Mar. 5, 2011.

Patent Owners' Request to Reopen Prosecution (Feb. 11, 2010); Requester comments on Request to Reopen Prosecution (Requester II) (Mar. 11, 2010).

Requester Comments on Request to Reopen Prosecution (Requester I) (Mar. 11, 2010); Examiner's Determination after Board Decision (Jun. 18, 2010).

Comments on Examiner's Determination after Board Decision (Patent Owner (Jul. 16, 2010); Comments on Examiner's Determination after Board Decision (Requester II) (Jul. 19, 2010).

Reply to Patent Owner's Comments (Requester II)(Aug. 16, 2010); Reply to Patent Owner's Comments (Requester 1)(Aug. 16, 2010).

Reply to Requester's Comments (Patent Owner)(Aug. 19, 2010); Appeal Docketing Notice (Oct. 1, 2010).

US Court of Appeals for the Federal Circuit, *C. Brown Lingamfelter* v. *David J. Kappos*, Director, US Patent and Trademark Office, Meadwestvaco Packaging systems, LLC and Graphic Packaging International, Inc., 2011-1449, Judgment/Opinion, 16 pages Aug. 9, 2012.

* cited by examiner

CONTAINER FOR PROVIDING EASY ACCESS TO BEVERAGE CANS

This is a continuation of and claims priority from U.S. patent application Ser. No. 10/997,712, filed Nov. 24, 2004, which is a continuation of and claims priority from U.S. patent application Ser. No. 10/935,209, filed Sep. 7, 2004, which is a continuation of and claims priority from U.S. patent application Ser. No. 10/388,951, filed Mar. 14, 2003 (now U.S. Pat. No. 6,789,673, issued Sep. 14, 2004); which is a continuation of and claims priority from U.S. patent application Ser. No. 09/946,004, filed Sep. 4, 2001 (U.S. Pat. No. 6,550,615); which is a continuation of and claims priority from U.S. patent application Ser. No. 09/542,661, filed Apr. 4, 2000 (U.S. Pat. No. 6,283,293).

FIELD OF THE INVENTION

Beverage can containers, more specifically a beverage can container for providing easy access to the beverage cans contained therein.

BACKGROUND INFORMATION

Beverages, such as soda or beer, often come in cylindrical, aluminum, typically 12 oz. cans. Traditionally, one could buy a single can or a "six pack." The six pack is simply six cans contained in a typically rectangular paper container or hung on interconnected plastic rings.

More recently, cans of soda and beer have become available in packs of twelve cans. The twelve pack is typically rectangular cardboard with the cans, usually in a 4×3 matrix arrangement, stacked closely next to one another. The twelve pack has walls typically constructed of light cardboard or thick paperboard, being thicker than writing stock paper but not as robust or thick as corrugated cardboard. These twelve packs presently enjoy popularity with use by Coca-Cola and Pepsi-Cola, the two leading providers of soda as well as by many major domestic beer companies.

The twelve pack containers provide a convenient means to carry the beverage cans but are not handy for dispensing the cans. Typically, the consumer will purchase the twelve pack, bring it home, tear the pack open and pull out the cans to stack them in the refrigerator, discarding the container. Applicant provides, however, for a modification to the currently available twelve pack to convert the carrying container to a dispensing container. That is, the cans will remain within the carrying container, the container acting, as modified by applicant as a beverage can dispenser.

An object of Applicant's present invention is to provide for a container for beverage cans which will allow easy access to the beverage cans for easy removal but will also hold the beverage cans therein.

It is also an object of Applicant's present invention to provide a modification to currently existing beverage can containers so that the containers, as modified, will provide easy access to the cans therein.

This and other objects are provided for in a generally rectangular, paper beverage can container with a corner removed on a diagonal line across the two side walls, the line running from a front wall to the adjacent top wall.

There are a number of benefits with Applicant's novel beverage container with a dispensing cutout therein. These include ease of access. This is obtained by placing the twelve pack container on edge with a cutout in the upper corner. Easy and fast accessibility to the cold beverage cans will increase consumption and sales of the product.

Applicant's invention also provides for gravity feed to enhance access to the beverage cans. This is created by the weight of the cans when the beverage container is placed in a vertical position. This position naturally pushes the cans, under the influence of gravity, towards the front wall of the container. The cutout location is designed to take maximum advantage of this gravity feed.

Another advantage of Applicant's invention is the ability to effectively utilize space, especially in a refrigerator or kitchen cabinet. By placement of the cutout in the position indicated, the container may be placed vertically to save space.

DETAILED DESCRIPTION OF THE PREFERRED EMBODIMENT

Line 12A shows the position of a line on the front wall of a beverage container from one side wall to the next, the line being straight and meeting the edge between the front wall and the side wall at a 90° angle. The line 12D shows the position of a diagonal line across each of the two side walls between the front wall and the top wall, lines 12D, at 12B and 12C showing a preferred range of the position of line 12D with respect to the top wall. Line 12E is a line across the top wall, one side wall to the next and perpendicular to the edges of the top wall. The beverage container will be cut through along lines 12A, 12D and 12E to remove section 12 from the rest of the container (See FIG. 1B). The position of lines 12A, 12D and 12E may be premarked, scored (or otherwise weaken) by the manufacturer of the beverage container so as to direct the consumer to the position for cutting and removing portion 12.

Figure 1:
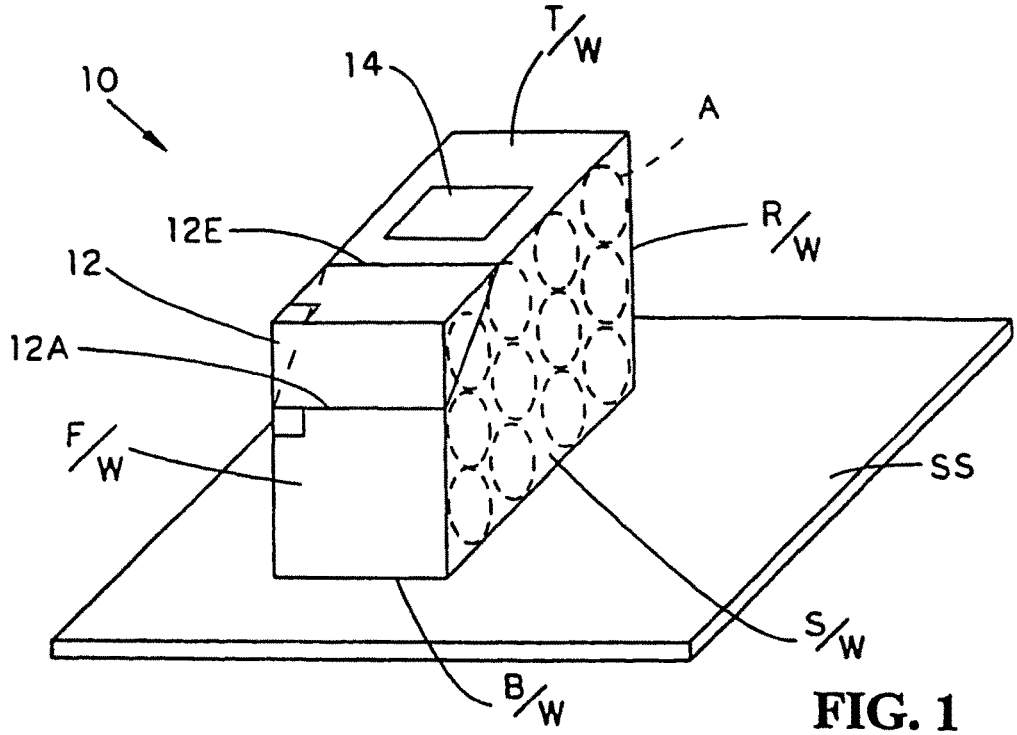
FIG. 1 is a perspective view of the preferred embodiment of applicants invention.
Figure 1B:
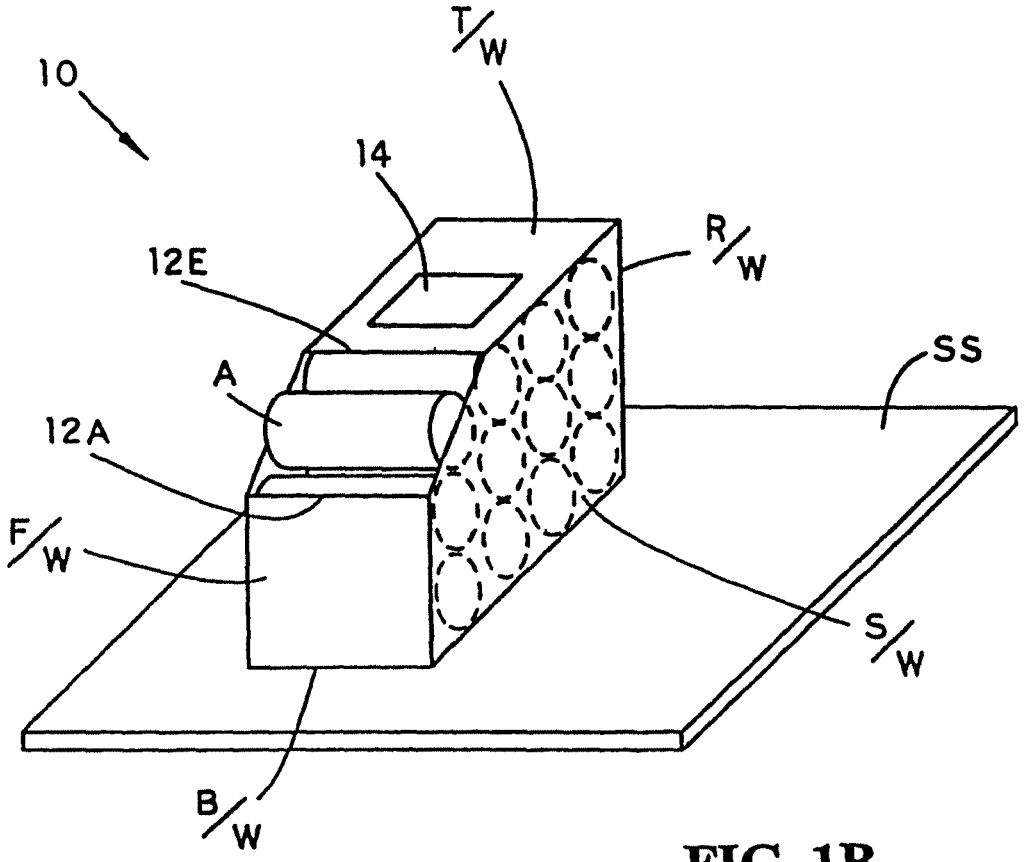
FIG. 1B is a perspective view of the beverage container modified accordingly to Applicant's invention.

FIG. 1 is a perspective view of a modified twelve pack container 10 with cylindrical aluminum 12 oz. beverage cans A packed inside in a 4×3 arrangement and designating two side walls S/W, a top wall T/W, a bottom wall B/W, a front wall F/W and a rear wall R/W. It is noted that the two side walls have the greatest surface area, the top and bottom walls having a surface area between the two side walls and the front and rear walls, which have the least surface area. A support surface, such as a refrigerator shelf, is designated SS. The top, bottom, front and rear walls are defined when the container is placed on a support surface, as illustrated in FIG. 1, with the F/W chosen to provide for the most convenient access. FIG. 1 also illustrates Applicant's modification, being a cut or removed portion 12, the removed portion being a corner of the container where the front wall meets the top wall and defined by a diagonal line across the two sidewalls between the front wall and the top wall, and a line across the top wall and across the front wall, this line along which the removed portion is defined designated 12A.

Figure 2:
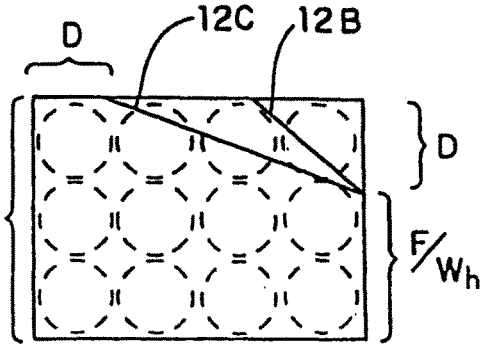
FIG. 2 is a side elevational view of the preferred embodiment of applicants invention.
Figure 1A:
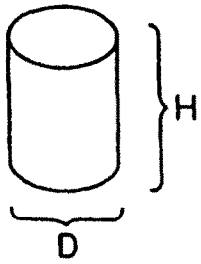
FIG. 1A is side view of a 12 oz. beverage can.

FIG. 2 illustrates a side elevational view of the twelve pack of FIG. 1 wherein the dimension designated D is the approximate diameter of a 12 oz. aluminum beverage can, typically about 6.6 centimeters. As can be seen in FIGS. 1 and 2 the typical twelve pack beverage container is a little over 4 diameters long (about 26 cms) and about 3 "diameters" high (about 20 cms) to enclose therein, in a 3×4 matrix, twelve cans. Furthermore it sometimes includes a handle 14 thereon, the handle typically being walls defining a cut out in the top wall for the receipt of a hand thereinto. The height (H) of a typical 12 oz. metal beverage can is about 12.6 cm.

In FIG. 2 it is seen that Applicant modifies the standard heavy paper wall twelve pack container by cutting off the corner created by the joinder of the front wall and top wall. This is preferably done in the manner illustrated in FIGS. 1 and 2. The preferred height of the front wall defined after the cut across the front wall is less than two diameters but greater than one diameter, more preferably between 1.50 and 1.80 times D. Indeed, the most preferred height of the front wall defining the cut to remove portion 12 is between 1¼ diameter and 1¾ diameter. Such dimension allows easy receipt of the second course of cans but is high enough to prevent the second course of cans from falling out when there are still 3 courses in the container.

The preferred length of the top wall defined after the cut is between 1 and 3 diameters, preferably between 1 and 2 diameters. These cut dimensions are illustrated by lines 12B and 12C set forth in FIG. 2.

Cuts along the lines 12A, 12D and 12E may be made with a knife, razor or any other suitable instrument. When the cuts are made as set forth in FIGS. 1 and 2, portion 12 can be removed (See FIG. 1B) and the single can at the top corner will then be removed and the container placed in the position illustrated in FIG. 1 for easy dispensing of the remaining cans.

Figure 3:
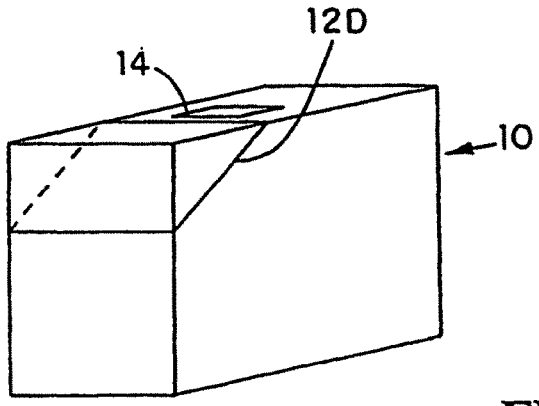
FIG. 3 is a side elevational view of an embodiment of Applicants invention.

FIG. 3 provides for a diagonal cut 12C across the side walls S/W's that terminates adjacent handle 14. Handle 14, in a 4×3 twelve pack is usually at 2 diameters from a top edge (half way across top wall T/W) to provide for proper balance.

Figure 4:
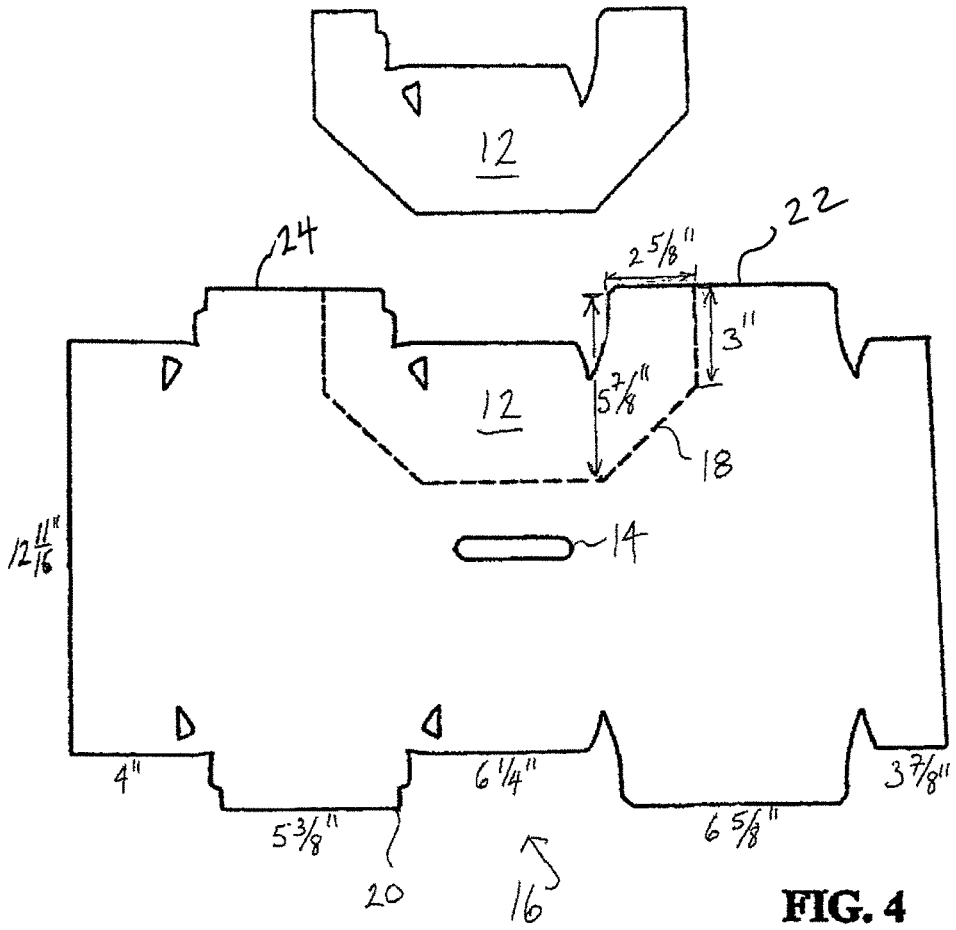
FIG. 4 is a two dimensional pattern of a typical paper twelve pack container illustrating the area removed to provide for applicants unique dispenser.

FIG. 4 illustrates a flattened twelve pack pattern 16 which will fold together to provide for a typical twelve pack with dimension. Handle 14 is illustrated. Scored line 18 is made as part of the process of constructing the container, typically after the outer perimeter 20 defining the pattern 16 of the box is formed. Scored line 18 may be grooves, scratches or notches, or any other means known in the trade to weaken the paperboard such that it is easier for the user to remove portion twelve. Indeed, with proper scoring in ways known in the trade, it is fairly easy to remove portion twelve without a cutting instrument. Note in FIG. 4 that folding the pattern 16 will provide for the twelve pack illustrated in FIGS. 1-3 with the diagonal line 12D running across the side walls from the front wall F/W to the top wall T/W. FIG. 4 shows first and second flaps 22 and 24, on which a portion of scored line 18 is made, and each of which is connected to a sidewall S/W. When the pattern 16 is folded together, the front wall F/W comprises the first and second flaps 22 and 24.

In an alternate preferred embodiment Applicant provides a twelve pack container with a line marked on the front wall F/W at between 1D and 2D, on the top wall T/W between 1D and 3D and across the two side walls S/W's to define the pattern for removal of a corner 12 of a twelve pack container as illustrated in FIGS. 1-4 to show a consumer that they may cut the container along the line to convert it into the Applicants novel dispenser container as illustrated.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

The invention claimed is:

1. A container holding a multiplicity of cylindrical cans arranged in a plurality of substantially perpendicular rows and columns, wherein each row has at least a first and second can, each can having a can diameter and a can height, wherein the arrangement has a top row and a next-to-the-top row, and wherein each column has a column width of the can diameter and each row has a row height of the can diameter, comprising: a rear wall and a front wall each having a height of a whole multiple of the can diameter, wherein the first can of each row is adjacent the front wall, and the second can of each row is adjacent the first can of the respective row; a bottom wall and a top wall each having a length of a whole multiple of the can diameter; two side walls between the bottom and top walls, the side walls separated by the can height; and a scored line having a front wall segment running on the front wall, a top wall segment having at least a part running on the top wall between the first and second cans of the top row, and side wall segments running on the side walls, the scored line defining a removable section of the container, and wherein at least a part of the front wall segment runs at a height less than the rear wall height; wherein each of the cans comprises a longitudinal axis, and wherein the front wall is substantially parallel to the longitudinal axis.

2. The container of claim 1, and further comprising a handle in the top wall.

3. The container of claim 1, wherein the multiplicity of cylindrical cans is an even number of cans.

4. The container of claim 1, wherein each of the cans comprises a full beverage can.

5. The container of claim 1, wherein a side wall segment is configured to allow more than one half of an end area of the first can in the top row to be exposed when the removable section is removed from the container.

6. The container of claim 5, wherein the side wall segment is configured to allow approximately three-quarters of the end area of the first can in the top row to be exposed when the removable section is removed from the container.

7. A container holding a multiplicity of cylindrical cans arranged in a plurality of substantially perpendicular rows and columns, wherein each row has at least a first and second can, each can having a can diameter and a can height, wherein the arrangement has a top row and a next-to-the-top row, and wherein each column has a column width of the can diameter and each row has a row height of the can diameter, comprising: a rear wall and a front wall each having a height of a whole multiple of the can diameter, wherein the first can of each row is adjacent the front wall, and the second can of each row is adjacent the first can of the respective row; a bottom wall and a top wall each having a length of a whole multiple of the can diameter; two side walls between the bottom and top walls, the side walls separated by the can height; and a scored line having a front wall segment running on the front wall, a top wall segment running on the top wall and having at least a part spaced apart from the front wall by one can diameter, and side wall segments running on the side walls, the scored line defining a removable section of the container, and wherein at least a part of the front wall segment runs at a height less than the rear wall height; wherein each of the cans comprises a longitudinal axis, and wherein the front wall is substantially parallel to the longitudinal axis.

8. The container of claim 7, and further comprising a handle in the top wall.

9. The container of claim 7, wherein the multiplicity of cylindrical cans is an even number of cans.

10. The container of claim 7, wherein each of the cans comprises a full beverage can.

11. The container of claim 7, wherein a side wall segment is configured to allow more than one half of an end area of the first can in the top row to be exposed when the removable section is removed from the container.

12. A method of manufacturing a container: providing a paper sheet member; scoring a portion of the sheet member with a score line; folding the sheet member around a plurality of items, each of the items having an item height, an item diameter, and a longitudinal axis, the folded sheet member defining a generally rectangular container having a top wall, a bottom wall, a front wall, a rear wall, and two side walls containing the items arranged in a plurality of substantially perpendicular rows and columns, each row having at least a first and second item wherein the first item of each row is adjacent the front wall, and the second item of each row is adjacent the first item of the respective row, the plurality of rows containing at least a top row and a next-to-the-top row, wherein a row height is equal to the item diameter and wherein the front wall and the rear wall are separated by a whole multiplicity of the item diameter and the top wall and the bottom wall are separated by a whole multiplicity of the row height, and the side walls are separated by the item height, and wherein folding the sheet member further comprises: locating at least a portion of the score line on the front wall so as to define an edge that is sufficiently high to restrain the next-to-the-top row; orienting the front wall substantially parallel to the longitudinal axes; locating at least a portion of the score line on the top wall such that the score line on the top wall is between the first and second items of the top row; and locating a portion of the score line on the side walls.

13. The method of claim 12, further comprising forming a handle in the top wall.

14. A container holding a multiplicity of cylindrical cans, each can having a can diameter and a can height, the container comprising: a rear wall and a front wall each having a height of a whole multiple of the can diameter; a bottom wall and a top wall each having a length of a whole multiple of the can diameter, the top wall including a handle; two side walls between the bottom and top walls, the side walls separated by the can height; and a scored line having a front wall segment running on the front wall, a top wall segment running on the top wall and at least a part spaced apart from the front wall by one can diameter, and side wall segments running on the side walls, the scored line defining a removable section of the container; wherein each of the cans comprises a longitudinal axis, and wherein the front wall is substantially parallel to the longitudinal axis.

15. The container of claim 14, wherein the multiplicity of cylindrical cans is an even number of cans.

16. The container of claim 14, wherein each of the cans comprises a full beverage can.

17. A container comprising: a multiplicity of substantially identical items held in the container in a plurality of rows, each item having an item diameter, an item height, and a longitudinal axis, wherein each row has a row height of the item diameter; a rear wall and a front wall each being substantially parallel to the longitudinal axes of the items, the rear wall and front wall separated by a whole multiple of the item diameter, the rear wall having a rear wall height; a bottom wall and a top wall separated by a whole multiple of the row height; two side walls between the bottom and top walls, the side walls separated by the item height; the rear, front, bottom, top, and side walls forming a substantially rectangular carton holding the items in an arrangement wherein each row includes a forward most item in contact with the front wall and a rearward most item in contact with the rear wall, and wherein each row has a second item adjacent the forward most item; and a scored line having a front wall segment running on the front wall, a top wall segment having at least a part running on the top wall between the forward most item and the second item, and side wall segments running on the side walls, the scored line defining a removable section of the container, and wherein at least a part of the front wall segment runs at a height less than the rear wall height.

18. The container of claim 17, and further comprising a handle in the top wall.

19. The container of claim 17, wherein the multiplicity of substantially identical items is an even number of items.

20. The container of claim 17, wherein each of the multiplicity of substantially identical items comprises a full beverage can.

21. A container holding an even multiplicity of cylindrical cans arranged in a plurality of substantially perpendicular rows and columns, wherein each row has at least a first and second can, each can having a can diameter and a can height, wherein the arrangement has a top row and a next-to-the-top row, and wherein each column has a column width of the can diameter and each row has a row height of the can diameter, comprising: a rear wall and a front wall each having a height of a whole multiple of the can diameter, wherein the first can of each row is adjacent the front wall, and the second can of each row is adjacent the first can of the respective row, and wherein the front wall comprises first and second flaps in contact with each other, each of the flaps connected to a sidewall; a bottom wall having a length of a whole multiple of the can diameter, wherein the entire bottom wall is adapted to rest on and be parallel with a support surface; a top wall having a length of a whole multiple of the can diameter, wherein the top wall is a single ply; two side walls between the bottom and top walls, the side walls separated by the can height; and a scored line having a front wall segment running on the first flap and on the second flap across the contact of the first and second flaps, a top wall segment having at least a part running on the top wall between the first and second cans of the top row, and side wall segments running on the side walls, the scored line defining a removable section of the container, and wherein at least a part of the front wall segment runs at a height less than the rear wall height, and a side wall segment is configured to allow more than one half of an end area of the first can in the top row to be exposed when the removable section is removed from the container; wherein each of the cans comprises a longitudinal axis, and wherein the front wall is substantially parallel to the longitudinal axis.

22. The container of claim 21, further comprising a handle in the top wall.

23. A method of dispensing a first cylindrical container from a package, the container having a container diameter and container height, the package including an enclosed carton and a plurality of containers disposed in at least a first row and a second row; the carton comprising a top, a bottom, a first side, a second side, an exiting end, and a closed end, wherein the top and bottom are separated by a whole multiple of the container diameter and the first and second sides are separated by the container height; the exiting end including a first side end flap connected to the first side and a second side end flap connected to the second side; the first side end flap contacting the second side end flap when folded to at least partially form the exiting end; the first container positioned in the first row above a second container in the second row; the first container contacting the top and the exiting end; a third container in the first row adjacent the first container; the carton including a dispenser defined at least partially by a tear line that includes a first tear line portion that extends across the first side end flap at least to the contact with the second side end flap, a second tear line portion that extends across the second side end flap at least to the contact with the first side end flap, a top tear line on the top at least a portion of which is spaced apart from the exiting end by one container diameter, a first side tear line on the first side, and a second side tear line on the second side; the method comprising: separating along the top tear line, the first side tear line, and the second side tear line to the first tear line portion and the second tear line portion; and removing the dispenser along the first tear line portion and the second tear line portion, so as to allow dispensing of the first container.

* * * * *